United States Patent [19]

Ibach et al.

[11] Patent Number: 4,845,361

[45] Date of Patent: Jul. 4, 1989

[54] PROCESS FOR ELECTRON BEAM GUIDING WITH ENERGY SELECTION AND ELECTRON SPECTROMETER

[75] Inventors: Harald Ibach, Aachen; Heinz-Dieter Bruchmann, Aldenhoven; Sieghart Lehwald, Juelich, all of Fed. Rep. of Germany

[73] Assignee: Kernforschungsanlage Juelich Gesellschaft mit beschraenkter Haftung, Juelich, Fed. Rep. of Germany

[21] Appl. No.: 149,596

[22] Filed: Jan. 28, 1988

[30] Foreign Application Priority Data

Jan. 30, 1987 [DE] Fed. Rep. of Germany ..... 3702696

[51] Int. Cl.[4] ..... H01J 45/48

[52] U.S. Cl. ..... 250/305; 250/396 R

[58] Field of Search ..... 250/305, 396 R, 310

[56] References Cited

U.S. PATENT DOCUMENTS 4,742,223 5/1988 Kesmodel ..... 250/305

OTHER PUBLICATIONS

A Low Energy Electron Impact Spectrometer for the Study of Excited States of Molecules in the Gas Phase, Roderick S. Stradling, Dept. of Chem., Univ. of London, Apr. 1, 77, pp. 595–600.

"Electron Monochromator Design", by Kuyatt et al., The Review of Scientific Instruments, vol. 38, No. 1, Jan. 1967.

*Primary Examiner*—Janice A. Howell

*Assistant Examiner*—Michael Aronoff

*Attorney, Agent, or Firm*—Foley & Lardner, Schwartz, Jeffery, Schwaab, Mack, Blumenthal & Evans

[57] ABSTRACT

High energy resolution at high electron current at the specimen or at the detector is obtained by an electron beam guiding with focusing energy selection, in particular in an electron spectrometer with emission system and at least one energy dispersive system with different focusing in two mutually perpendicular directions, by a non-circular-symmetrical lens system placed after or before the energy dispersive system and correcting the different focusing of the electrons in the two mutually perpendicular directions such that either the virtual or the real entry stop of the energy dispersive system is imaged on an accessible image plane outside the energy dispersive system or an object outside the energy dispersive system is imaged on the virtual or real exit stop of the latter.

11 Claims, 5 Drawing Sheets

ROTATABLE ABOUT 90°

4
5
6
EXIT GAP OF THE MONOCHROMATOR
LENS ELEMENTS
PROBE LOCATION
4
5
6

PROCESS FOR ELECTRON BEAM GUIDING WITH ENERGY SELECTION AND ELECTRON SPECTROMETER

BACKGROUND OF THE INVENTION

The invention relates to a process for electron beam guiding with focusing energy selection in an energy dispersive system with different focusing in two mutually perpendicular directions (especially in energy selection direction and perpendicular thereto in systems focusing in one plane only), and also to electron spectrometers with at least one energy dispersive system with such a beam guidance.

Bundled electrons with given energy are used for the treatment and research of surfaces and gases. For a focusing energy selection, energy dispersive systems are known which are put to use either singly as analyzers or as monochromators or in a combination of an analyzer and a monochromator as a so-called electron impact spectrometer.

Energy dispersive systems as analyzers are used, for example, in UV or X-ray photoelectron spectroscopy (also known by the name ESCA) and in Auger spectroscopy. Here electrons emitted by the specimen are analyzed by the analyzer with respect to their kinetic energy. A lens system situated between the specimen and the analyzer provides for beam transport, the matching of the electron energy to the transmission energy of the analyzer, and also the required enlargement or diminution of the image of the imaged surface of the specimen for matching to the entry slit of the analyzer.

Energy dispersive systems are also used for production of monochromatic electron beams, for example in inverse photoemission spectroscopy. Similarly to the case of the analyzer described above, lens systems are inserted between the monochromator and the specimen for beam transport, and for matching the energy and image size.

In an electron impact spectrometer, the electrons emitted by a cathode are monochromatized in one or more monochromators and focused by a lens system onto a specimen; usually the energy of the electrons at the specimen can be different from the energy in the monochromator. The electrons striking the specimen are scattered by the latter and thereby suffer characteristic energy losses, for example by excitation of vibration quanta. The scattered electrons are conducted by a lens system to the entry slit of one or more energy dispersive elements which analyze the scattered electrons with respect to their energy distribution, and are detected in a detector. Electron spectrometers of this kind are in particular used for vibrational spectroscopy and for investigation of electronic losses on the surfaces of solids, and are made by a number of firms.

In an electron collision spectrometer, the maximum attainable intensity of the beam falling on the specimen, and hence also the intensity of the useful signal produced by the latter, is basically limited by the space charge in the monochromator. Theoretical calculations show (H. Ibach, D.L. Mills, Electron Energy Loss Spectroscopy and Surface Vibrations, Academic Press, New York, 1982, pp. 16 ff.) that the strength of the monochromatic beam depends on the energy width of the electron beam passed through by the monochromator and can only be influenced to a relatively modest extent by design parameters of the system.

Favorable circumstances as regards space charge result in particular from the use of one or more cylindrical condensers with slits as entry and exit apertures. Focusing of the electrons from the entry aperture to the exit aperture and energy selection here result only in the radial direction, while perpendicular to this neither focusing now energy selection occur. The lack of focusing perpendicular to the radial plane (without the beam guiding according to the invention) has disadvantageous effects on the intensity of the useful signal. The same likewise applies to the analyzer when cylindrical condensers are utilized there.

Attempts have been made (see European Pat. No. 0013003) to compensate for this known disadvantage of cylindrical condensers in that the electrons emitted by the cathode are focused in the radial plane by a suitable lens system onto the entry slit of the monochromator, while perpendicular to this they are focused by a corresponding design of the cathode system and also of the lens system between monochromator and specimen and between specimen and analyzer into an approximately parallel beam path without further intermediate focus on the detector. This beam guiding offers an improvement as against a free non-focusing beam spreading (in the perpendicular direction).

An analogous kind of focusing is described in U.S. Pat. No. 4,559,449.

Closer investigation shows, however, that a series of decisive disadvantages remain. Thus the angle of the beam bundle reaching the detector is small perpendicular to the radial plane, so that according to the fundamentals of optics the intensity remains ;small. Furthermore, perpendicular to the radial plane the beam path at the specimen is nearly parallel.

This means that only a small solid angle of the scattered electrons is caught. Besides this, the described kind of beam guiding is liable to disturbances for small error potentials, which are unavoidable at the frequently used low energies due to inhomogeneities of the surface potentials.

SUMMARY OF THE INVENTION

An object of the invention, therefore, is to provide a process for beam guiding with focusing energy selection or in an energy dispersive system with different focusing in two mutually perpendicular directions.

Another object of the invention is to provide an electron spectrometer apparatus in which a high energy resolution is achieved with high electron current at the specimen or at the detector.

These and other objects are achieved by a method and apparatus in which the different focusing of the electrons in the two mutually perpendicular directions is corrected by a lens system which is not circular symmetrical and which is placed either before or after the energy dispersive system, such that either the virtual or the real entry aperture of the energy dispersive system is imaged on predetermined (accessible) image plane outside the energy dispersive system or an object outside the energy dispersive system is imaged on the virtual or real exit aperture of the same.

Apparatuses with beam guiding according to the invention include electron monochromators with a following correcting lens system between the monochromator and the specimen (or object) or analyzers with a correcting lens systems in front between specimen and analyzer, and also electron impact spectrometers with such a lens system between the monochromator and specimen and/or between specimen and analyzer. The invention will be particularly explained with reference to an electron impact spectrometer which is built symmetrically with respect to the monochromator and the analyzer. An electron impact spectrometer as described above consists of a monochromator part with a lens system placed after the monochromator and an analyzer part with a lens system placed before the analyzer. The invention can also, however, be utilized for a monochromator with lens system placed after it and for an analyzer with lens system placed before it, with advantages for the different cases of application.

The different focusing between monochromator and specimen or specimen and analyzer distinguishes the arrangement according to the invention for the spectrometer according to U.S. Pat. No. 4,559,449, in which no different focusing in both directions is provided, but only a separation of the lenses for beam deflection.

BRIEF DESCRIPTION OF THE DRAWINGS

With the above as background, reference should now be made to the following figures for a detailed description of the invention in which.

DETAILED DESCRIPTION OF THE PREFERRED EMBODIMENTS

The lens systems with different focusing in two mutually perpendicular directions to be utilized in the present invention are embodied or dimensioned while taking into account the focusing task and the electron paths in the energy dispersive system. In a special embodiment of the invention, rectangular lens cross section profiles can be used, in which the height and width are matched to each other so that in cooperation with the focusing properties of the energy dispersive system different focusing of the electrons in the two mutually perpendicular directions is accomplished and the aforementioned imaging occurs. When cylindrical condensers are used as energy dispersive systems, the axes of symmetry of the rectangular profile must be parallel or perpendicular to the radial plane. The required height and width of the lens cross section profile are calculated by solution of the Laplace equation in three dimensions and calculation of the electron paths in three dimensions in the manner known to one skilled in the art. See, for example, O. Klemperer "Electron Optics", Cambridge Univ. Press, London and New York, 1971, A.B. El-Kareh and P.C.F. El-Kareh, "Electron Beams, Lenses and Optics." Vols. 1 and 2 Academic Press, New York, 1970, P. Grivet, "Electron Optics", Pergamon, Oxford, 1965 incorporated herein by reference.

For the correction of imaging errors, in particular of the astigmatism error which is important for the imaging of a slit, it has been found that it is appropriate to deviate from the rectangular shape for one or more lens elements and to provide lens cross section profiles in which the open width along a symmetry axis has, for example, a trapezoidal or stepped or curved taper.

Figure 1:
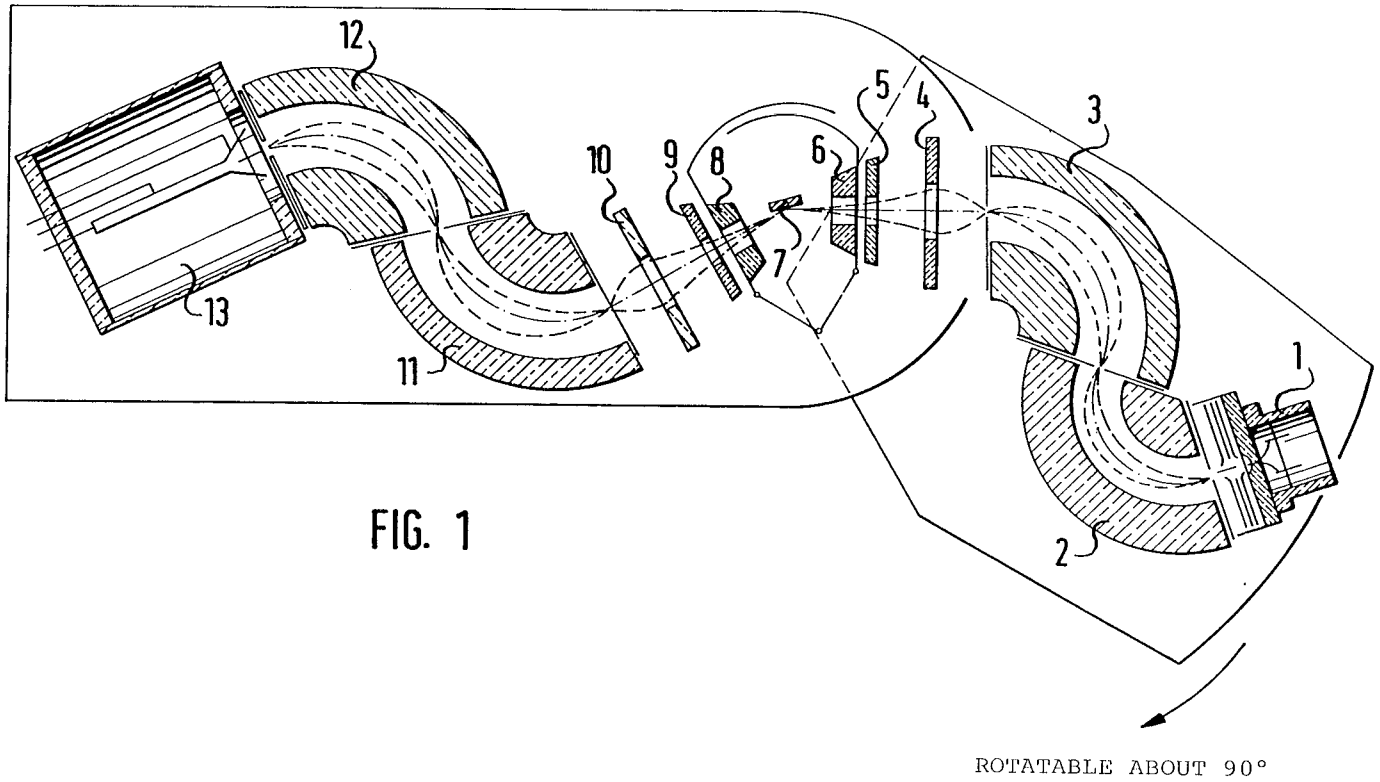
FIG. 1 shows an electron spectrometer with two respective monochromators and analyzers.

Referring now to FIG. 1, an electron spectrometer according to the present invention is shown having a cathode system 1, two monochromators 2 and 3, a lens system consisting of three elements 4, 5 and 6 between the monochromators and the specimen 7, and a lens system consisting of the elements 8, 9 and 10 between the specimen 7 and two analyzers 11 and 12 and a detector 13. The two lens systems between monochromator and specimen and between specimen and analyzer are mutually symmetrical, so that the lens elements 4 and 10, 5 and 9, and also 6 and 8, are correspondingly alike.

Figure 2:
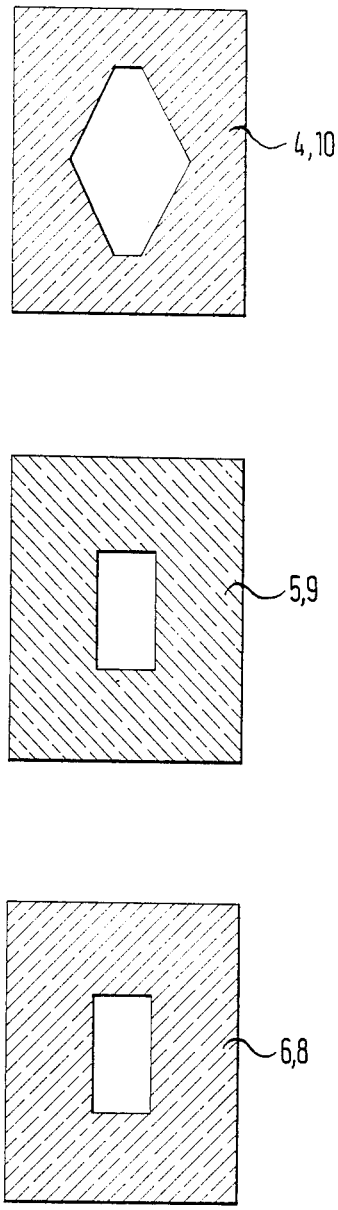
FIGS. 2 and 3 show cross sectional profiles of the lens elements of the lens systems illustrated in FIG. 1.
Figure 3:
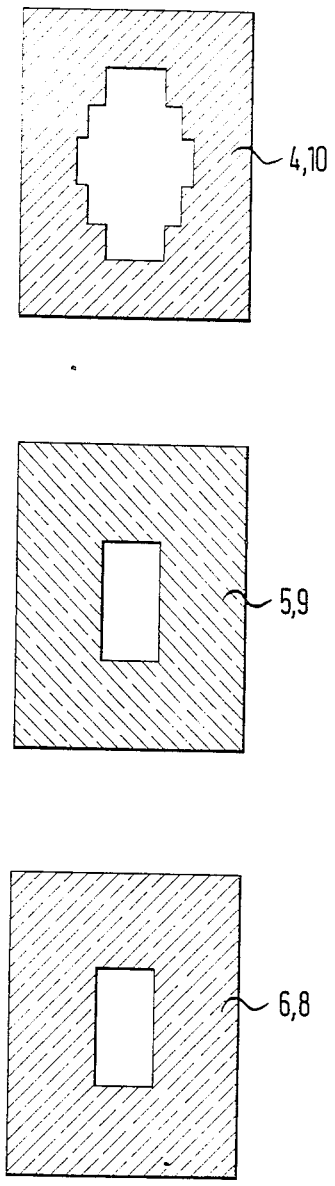

The cross sectional profile of these lens elements 4–6 or 8–10) are shown in FIGS. 2 and 3; of these, the lens element 4 is trapezoidal or tapered stepwise, and the elements 5 and 6 are rectangular in shape.

Figures 4A, 4B:
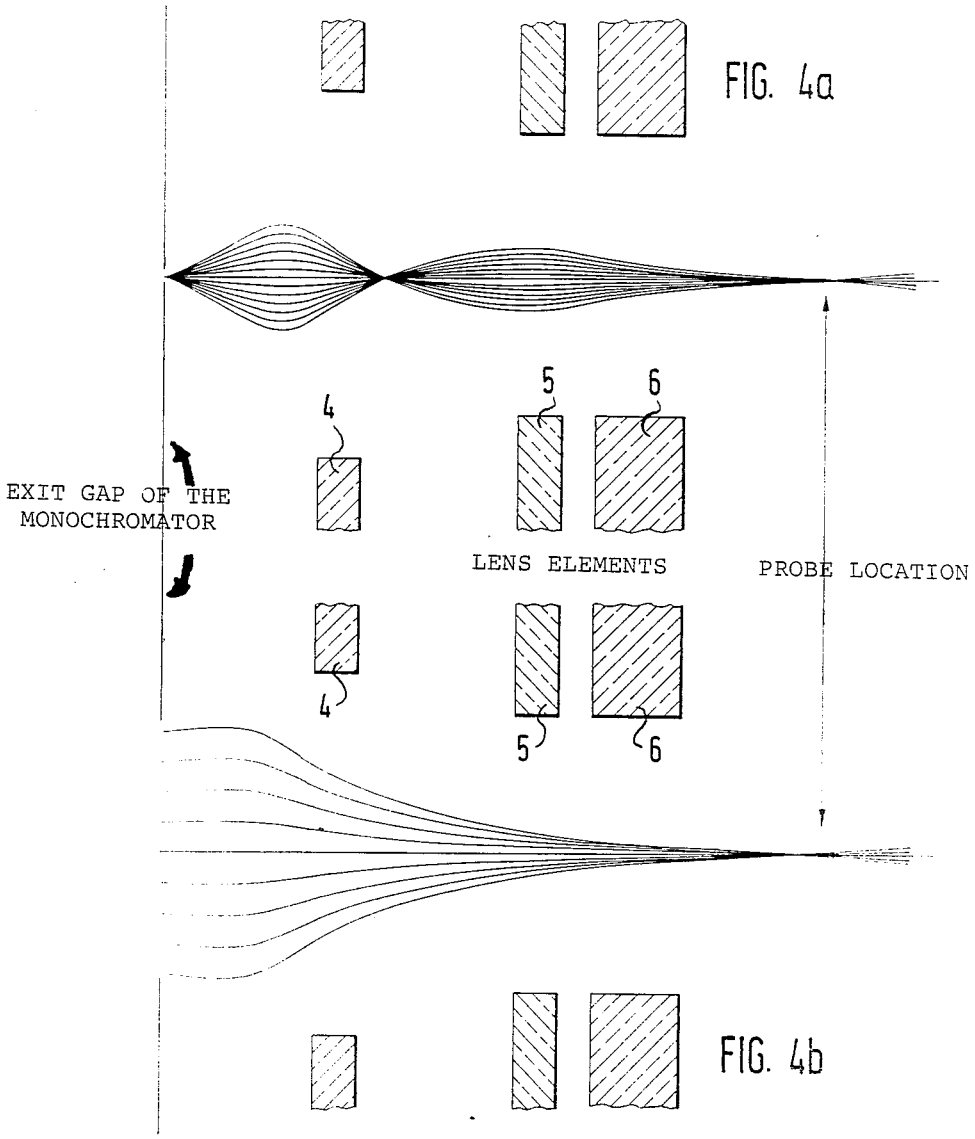
FIG. 4 shows the electron paths between the exit slit of the monochromator and the specimen (a) in the radial plane and (b) at right angles to the radial plane.

The height and width of the open profile of the lens elements 4, 5 and 6 are determined such that, in cooperation with the imaging in the radial plane by the cylindrical condensers, in the radial plane (=plane of the drawing in FIG. 1) the exit slit of the monochromator is imaged on the specimen (FIG. 4a), and perpendicular thereto the entry slit is imaged on the specimen (FIG. 4b whereby the linear rearward extensions of the illustrated beams meet at a point in the entry slit), so that overall an image of the entry slit of the first monochromator results at the specimen. It is important for this mode of operation that no lens elements exist between the first and second monochromators. The required imaging on the specimen is achieved exclusively by the lens system 4–6 in cooperation with the monochromators. The height and width of the profiles of the lens elements 8, 9 and 10 are similarly matched such that in the radial plane the specimen is imaged on the entry slit of the first analyzer, and perpendicularly thereto the specimen is imaged on the exit slit of the last analyzer, so that overall an image of the specimen results at the exit slit of the second analyzer.

Figure 5:
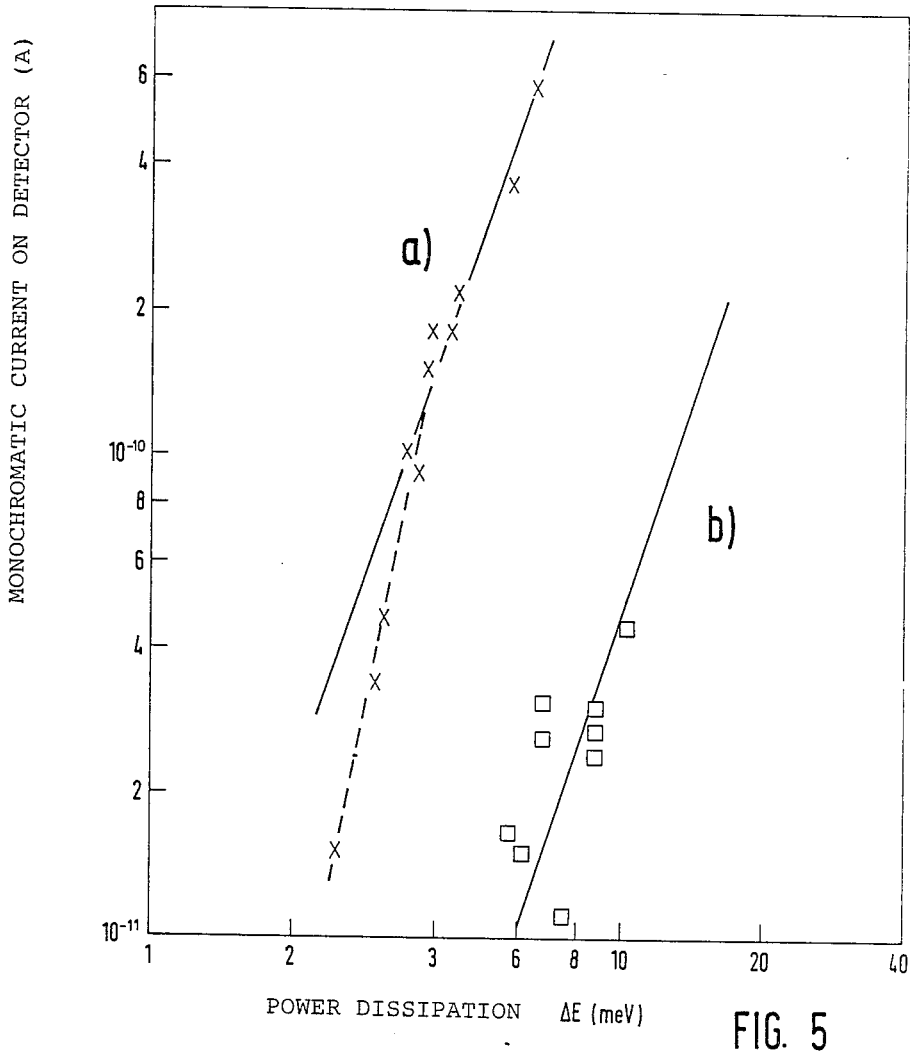
FIG. 5 is a diagram of the course of the monochromatic current at the detector independence on the energy resolution with and without beam guiding according to the present invention.

The monochromatic current achieved by use of the lens system according to the invention, measured at the detector, can be seen from FIG. 5, Curve A, as a function of resolution. The full line curve A illustrates the expected power law whereas the dashed curve A represents the experimentally observed results (for the lens elements shown in FIG. 3). In comparison with this, Curve B shows analogous values for a spectrometer (as disclosed in the European Pat. No. 0013003) which does not have the lens system according to the invention, but which is nevertheless alike in construction as regards the monochromators and analyzers. The data concern an electron energy at the specimen of 100 eV, while the energy of the electrons in the monochromators and analyzers (according to resolution) is below 1 eV.

The invention has been described in detail will particular reference to preferred embodiments thereof, but it will be understood that variations and modifications can be effected within the spirit and scope of the invention.

Instead of cylindrical condensers as energy dispersive systems in the monochromator and/or analyzer, plate condensers can also be used and likewise focus in only one plane. energy dispersive systems can also be used which have a different focusing, respectively different from null, in two mutually perpendicular directions; a correspondingly matched design of the lens system (choice of height and width of the lens profiles) is then to be carried out such that the desired focusing results.

What is claimed is:

1. An electron spectrometer apparatus comprising:
an electron emission unit that produces an electron beam;
an energy dispersive unit that provides energy selection of the electron beam before the electron beam reaches a specimen location; and
a lens system located after the energy dispersive system and before the specimen location, which provides non-circular focusing in two mutually perpendicular directions, that focuses the electron beam, in cooperation with the focusing properties of the energy dispersive system, and produces an image of a virtual or real entry aperture of the energy dispersive system at the specimen location.

2. An electron spectrometer apparatus comprising:
an electron emission unit that produces an electron beam;
an energy dispersive unit, located after a specimen location, that provides energy selection of the electron beam after the electron beam reaches the specimen location; and
a lens system, located between the specimen location and the energy dispersive unit, that provides non-circular focusing in two mutually perpendicular directions wherein the lens system, in cooperation with the focusing properties of the energy dispersive system, images an image from the specimen location onto a virtual or real exit aperture of the said energy dispersive system.

3. An electron spectrometer apparatus comprising:
an electron emission unit that produces an electron beam;
a first energy dispersive unit that provides energy selection of the electron beam before the electron beam reaches a specimen location;
a first lens system located after the energy dispersive system, that provides non-circular focusing in two mutually perpendicular directions, that focuses the electron beam, in cooperation with the focusing properties of the first energy dispersive system, and produces an image of a virtual or real entry aperture of the first energy dispersive system at the specimen location;
a second energy dispersive unit, located after a specimen location, that provides energy selection of the electron beam after the energy beam reaches the specimen location;
and a second lens system, that provides non-circular focusing in two mutually perpendicular directions, located between the specimen location and the second energy dispersive unit, the second lens system, in cooperation with the focusing properties of the second energy dispersive system, imaging the image at the specimen location onto a virtual or real exit aperture of the second energy dispersive system.

4. An electron spectrometer apparatus as claimed in claim 3, wherein the first and second energy dispersive systems focus only in one direction.

5. An electron spectrometer apparatus as claimed in claim 3, wherein the first and second lens systems comprise a plurality of lens elements, and at least one of the lens elements have an lens opening cross section profile that is non-circular.

6. An electron spectrometer apparatus as claimed in claim 5, wherein at least one of the plurality of lens elements has a rectangular lens opening cross section profile.

7. An electron spectrometer apparatus as claimed in claim 5, wherein at least one of the plurality of lens elements have a trapezoidal, step-shaped or curved taper along one axis of a lens opening cross sectional profile.

8. An electron spectrometer apparatus comprising:
an electron emission unit that produces an electron beam;
a first energy dispersive unit that provides energy selection of the electron beam before the electron beam reaches a specimen location, said first energy dispersive unit including a first monochromator immediately followed by a second monochromator;
a first lens system located after the energy dispersive system, that provides non-circular focusing in two mutually perpendicular directions, that focuses the electron beam, in cooperation with the focusing properties of the first energy dispersive system, and produces an image of a virtual or real entry aperture of the first energy dispersive system at the specimen location;
a second energy dispersive unit, located after a specimen location, that provides energy selection of the electron beam after the electron beam reaches the specimen location;
and a second lens system, that provides non-circular focusing in two mutually perpendicular directions, located between the specimen location and the second energy dispersive unit, the second lens system, in cooperation with the focusing properties of the second energy dispersive system, imaging the image at the specimen location on a virtual or real exit aperture of the second energy dispersive system.

9. An electron spectrometer apparatus as claimed in claim 3, wherein the first and second energy dispersive systems are formed of cylindrical condensers.

10. A method of guiding and focusing an electron beam, said method comprising the steps of:
passing the electron beam through an energy dispersive system to select a specified energy range of the electron beam;
focusing the electron beam passed through the energy dispersive system in two mutually perpendicular directions with a lens system which is non-circular; and
imaging a virtual or real image of an entry aperture of the energy dispersive system on an accessible image plane outside the energy dispersive system.

11. A method of guiding and focusing an electron beam emitted from a specimen, said method comprising the steps of:
focusing a portion of the electron beam emitted from the specimen in two mutually perpendicular direction with a lens system that is non-circular; and
passing the focused portion of the electron beam through an energy dispersive system such that an image of the specimen is imaged on a virtual or real exit aperture of the energy dispersive system.

* * * * *